US006462660B1

(12) United States Patent
Cannon et al.

(10) Patent No.: US 6,462,660 B1
(45) Date of Patent: Oct. 8, 2002

(54) WIRELESS PICONET-BASED PERSONAL ELECTRONIC PROPERTY REMINDER

(75) Inventors: Joseph M. Cannon, Harleysville; James A. Johanson, Macungie; Philip D. Mooney, Sellersville, all of PA (US)

(73) Assignee: Agere Systems Guardian Corp., Miami Lakes, FL (US)

( * ) Notice: Subject to any disclaimer, the term of this patent is extended or adjusted under 35 U.S.C. 154(b) by 0 days.

(21) Appl. No.: 09/768,787

(22) Filed: Jan. 25, 2001

(51) Int. Cl.[7] ..... G08B 13/14

(52) U.S. Cl. ..... 340/572.1; 340/539; 340/568.1; 340/573.1

(58) Field of Search ..... 340/425.5, 426, 340/531, 539, 568.1, 573.1, 666, 691.1, 691.6, 7.27, 7.28, 311.2, 988

(56) References Cited

U.S. PATENT DOCUMENTS 4,897,630 A * 1/1990 Nykerk ..... 340/426
5,623,242 A * 4/1997 Dawson, Jr. et al. .... 340/311.1
5,640,144 A * 6/1997 Russo ..... 340/568.1
5,872,505 A * 2/1999 Wicks et al. ..... 340/311.1
6,004,020 A * 12/1999 Bartur ..... 700/236
6,049,697 A * 4/2000 Scozzarella et al. ..... 455/31.2
6,087,952 A * 7/2000 Prabhakaran ..... 340/693.5
6,091,959 A * 7/2000 Souissi et al. ..... 340/988
6,192,340 B1 * 2/2001 Abecassis ..... 704/270
6,294,999 B1 * 9/2001 Yarin et al. ..... 340/573.1

* cited by examiner

*Primary Examiner*—Van T Trieu
(74) *Attorney, Agent, or Firm*—Dickstein Shapiro Morin & Oshinsky LLP

(57) ABSTRACT

An system and method of reminding a user of any missing portable electronic devices when leaving a location. A reminder device transmits a signal to each of the reminder enabled devices. The reminder device then alerts the user of any reminder enabled devices that did not transmit acknowledgement signals.

73 Claims, 8 Drawing Sheets

WIRELESS PICONET-BASED PERSONAL ELECTRONIC PROPERTY REMINDER

FIELD OF THE INVENTION

The present invention relates to a system and method for reminding users of forgotten portable electronic devices.

BACKGROUND OF THE INVENTION

In recent years, use of portable electronic devices, such as, for example, cellular telephones, personal data assistants (PDAs), personal computers, pagers, and the like, have increased greatly. People rely on these devices at work, home, and when traveling. As a result, when a user forgets a portable electronic device, it often creates a problem and in many instances must backtrack to retrieve the forgotten device. Currently there is no way for a person to insure that he or she has not forgotten any of his or her essential devices when leaving a location other than by going over a checklist.

Thus, there exists a desire and need for a system and method for checking if a person has all of their portable electronic devices with them when leaving a location such as, for example, home, work, car, a hotel, etc. There is also a need for a system and method to ensure that a person does not have unneeded devices when leaving a location. In another aspect, the invention is a method and system which ensures that a person does not leave a location with unneeded or unnecessary personal electronic devices.

SUMMARY OF THE INVENTION

The present invention mitigates the problems associated with the prior art and provides, in one aspect, a unique method and system for providing an automatic reminder thereby insuring that a person does not forget any personal electronic devices when leaving a location.

In accordance with one embodiment of the present invention, portable electronic devices such as, for example, cellular telephones, PDAs, laptops, pagers, MP3 players, watches, etc. are provided with transceivers. When the user performs a predefined action, such as, for example, starts his car, opens the front door of his house, or opens a garage door, etc. a controller at the location checks which devices should be present with the user at that time. A transceiver at the location communicates with each of the specified portable electronic devices which should be present using low power radio signals to verify that each portable electronic device is within a pre-determined short range of the location, e.g. is with the user or in the car. The location controller notifies the user of any of the specified portable electronic devices which are not within the pre-determined short range of the controller.

In accordance with another embodiment of the present invention, portable electronic devices are provided with transceivers. At a specified time, a controller in the user's watch, beeper, or cellular telephone communicates via a transceiver with each of the specified portable electronic devices using low power radio signals to verify that each portable electronic device is within a pre-determined short range, e.g. is with the user or in the immediate vicinity. The controller within the watch, beeper, or cellular telephone then notifies the user if any of the specified portable electronic devices are not within a pre-determined short range.

In accordance with another embodiment of the present invention, portable electronic devices are provided with transceivers. When a user performs a specified action, a controller at his location checks to maker sure that no unneeded or unnecessary devices are present e.g. within a predetermined distance of the controller. So that a user is not burdened with unnecessary unneeded devices.

BRIEF DESCRIPTION OF THE DRAWINGS

The above and other features of the invention will be more readily understood from the following detailed description of the invention which is provided in connection with the accompanying drawings.

FIG. 3 is a flowchart of an exemplary method implemented in a reminder enabled device for a wireless piconet-based personal property reminder;

DETAILED DESCRIPTION OF THE PREFERRED EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that structural changes may be made and equivalent structures substituted for those shown without departing from the spirit and scope of the present invention.

Figure 1:
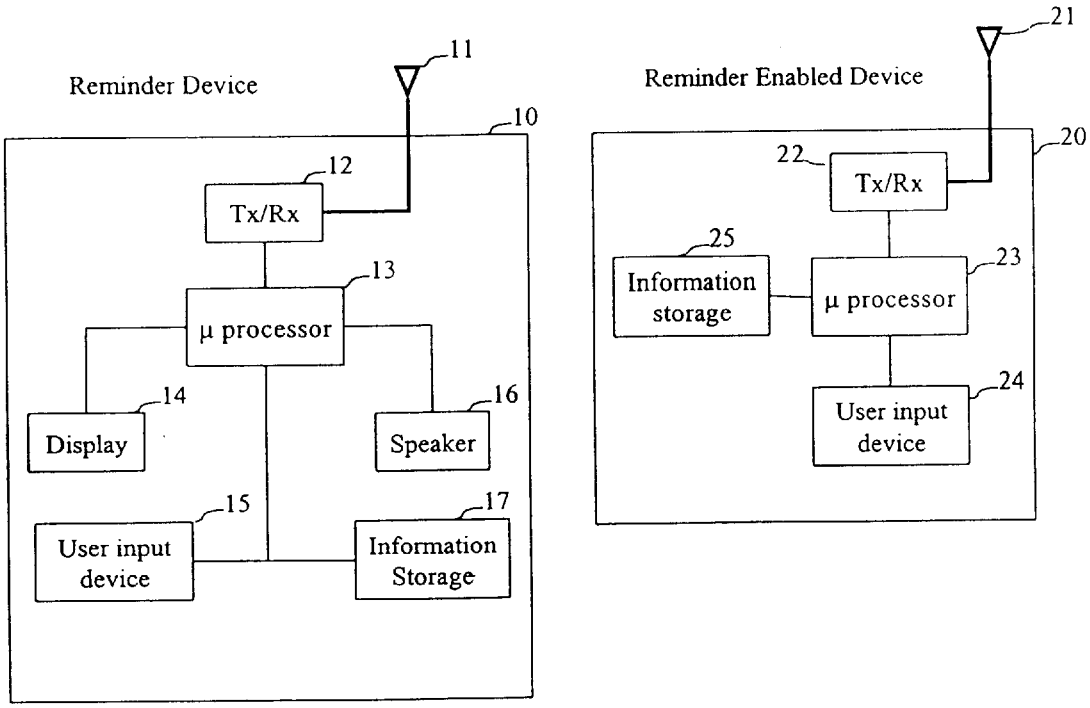
FIG. 1 is a block diagram of a reminder enabled device and a reminder device.

FIG. 1 illustrates in block diagram form a reminder device 10 and a reminder enabled device 20 according to the present invention. In accordance with the present invention, the reminder device 10 verifies that all reminder enabled devices 20 are present when a reminder event occurs. A reminder event can be a preset time, opening a car door, starting a car, opening a garage door, opening the front door of a house, etc.

Figure 1A:
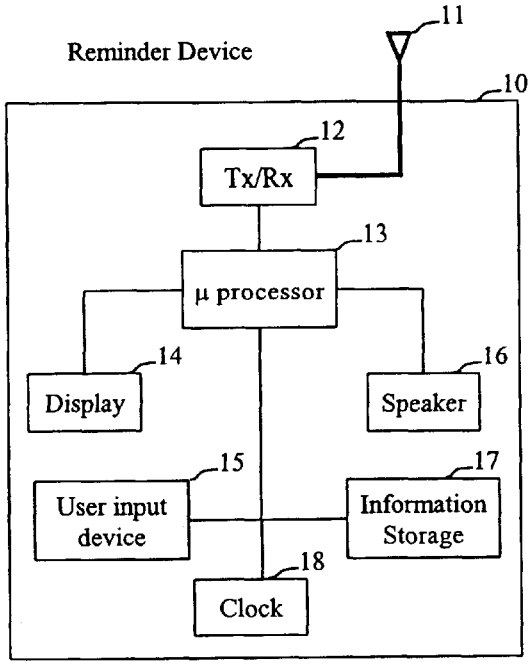
FIG. 1*a* is a block diagram of a reminder device incorporating a clock.
Figure 1B:
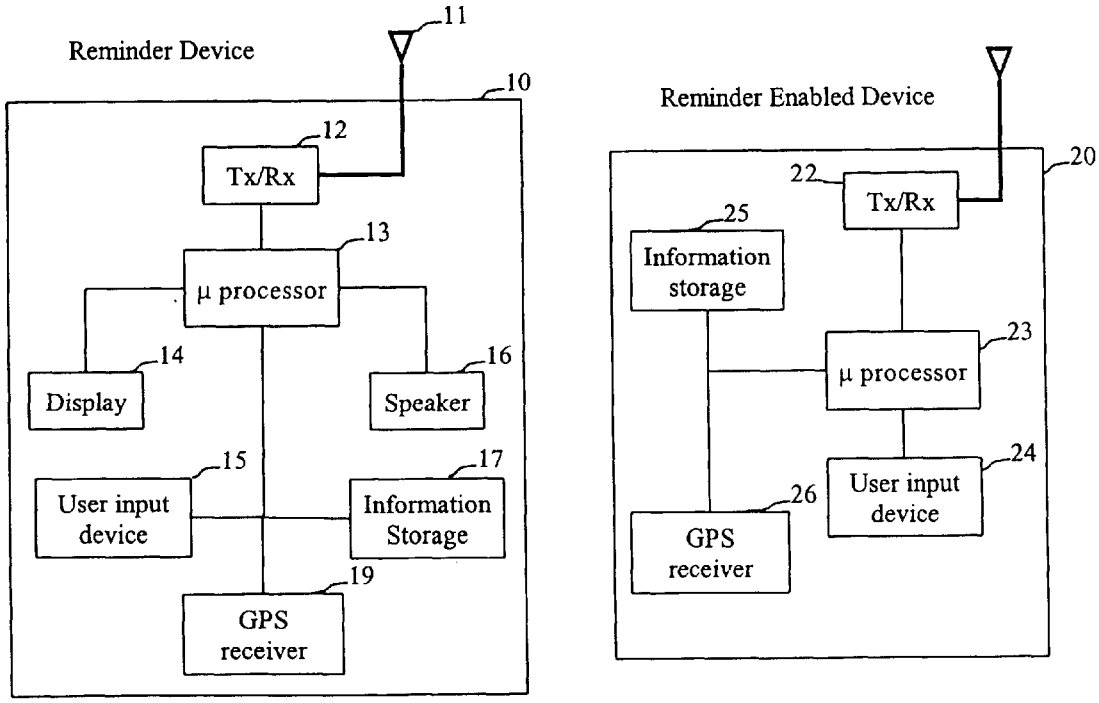
FIG. 1*b* is a block diagram of a reminder enabled device incorporating a GPS receiver.

A reminder device 10, such as, for example, a car's computer, a watch, garage door opener, beeper, etc., is provided with a transceiver 12. The transceiver is connected to a controller, for example, a microprocessor 13 and is provided with an antenna 11 for broadcasting and receiving radio signals. The reminder device 10 is also provided with a user input device 15 for inputting which portable electronic devices 20 to verify the presence of and when to verify the presence of each portable electronic device 20 into an information storage device 17. The input device may be a keypad, keyboard, mouse, etc. The reminder device 10 may also have a display. 14 for displaying visually those devices that are not present, or a speaker 16 for providing an audio alert that one or more devices 20 are missing. A reminder device 10 enabled for a preset time to be used as a reminder event is illustrated in FIG. 1*a*. The only difference between reminder device 10 in FIG. 1 and FIG. 1*a* is the addition of clock 18. A reminder device enabled to determine if reminder enabled device 20 is within a threshold proximity by comparing the location of each device as determined by a global positioning satellite is illustrated in FIG. 1*b*. The only difference between reminder device 10 illustrated in FIG. 1 and FIG. 1*b* is the addition of a global positioning satellite receiver in FIG. 1*b*.

A reminder enabled device 20, such as, for example, a wireless telephone, PDA, a transferable tag that may be attached to any item, laptop computer, wristwatch or the like, is provided with a transceiver 22. The transceiver 22 is connected to a controller, e.g. microprocessor 23 in the device 20. The transceiver 22 is provided with an antenna 21 for broadcasting and receiving radio signals. The device 20 may be provided with a user input device 24 for inputting information to identify the device 20 for storage in memory 25. The input device may be a keypad, keyboard, mouse, etc. A reminder enabled device 20 incorporating a global positioning satellite receiver is illustrated in FIG. 1*b*. The only difference between reminder enabled device 20 illustrated in FIG. 1 and FIG. 1*b* is the addition of GPS receiver 26.

In accordance with one exemplary embodiment of the invention, portable electronic devices, such as, for example, a cellular telephone, a laptop, a PDA, and a transferable tag are all reminder enabled devices 20. The reminder device 10 can be provided at a specified location, for example, at a house, in an automobile or even on a user. The reminder 15 device 10 can be programmed with information concerning which portable electronic devices need to be checked for and when a check is to be made through the user input device 15. The user input device 15 can be a keyboard, keypad, mouse, etc. When the user selects a portable electronic device 20 to be reminded about, the days to check for the portable electronic device 20 and the time or event at which to check for the presence of the portable electronic device 20 can be entered through user input device 15. For example, it may not be necessary to check for a laptop computer on Saturdays or Sundays. Accordingly, the reminder device 10 can be programmed to check for a laptop computer only on Monday through Friday. The portable electronic device 20 identification information can be input into the portable electronic device 20 either through a signal from the reminder device 10 or from a user input device 24 connected to the portable electronic device 20. The user can also select to be reminded when certain devices that are present which should not be present. For example, if a user does not want to have a laptop on weekends, the user can set the reminder device to generate a reminder if the laptop is present on Saturday or Sunday. In addition, an electronic calendar can form part of, or can communicate with a reminder device 10 so that the reminder device can check for the devices that are necessary and should be present for the current day's schedule as well as for devices that are not needed and should not be present for the current day's schedule.

When an activation event occurs at a location containing a reminder device 10, for example, when a door of a car 10 is opened, a computer 13 in car 10 broadcasts a signal via transceiver 12 which contains identification information for the first portable electronic device 20 to be checked for. Each of the reminder enabled devices 20 that are within range receive the signal and compare the portable electronic device 20 identification information contained in the signal to the information in the information storage device 25. If the first portable electronic device 20 is within range of the transmission, the information in the signal will match the information in the information storage device of the first portable electronic device 20 and the first portable electronic device 20 will broadcast an acknowledgement signal.

Once the computer 13 of the car 10 receives the acknowledgement signal through transceiver 12, it repeats the process for each other portable electronic device 20 which should be present in the vicinity of the reminder device 10. If a portable electronic device 20 does not broadcast an acknowledgment signal, the computer 13 displays a message on the display 14 and/or provides an audible signal through speaker 16 informing the user that the portable electronic device 20 is absent. The acknowledgment signal can also contain information about the status of reminder enabled device 20. For example, the acknowledgment signal can contain battery power information for a laptop. The user alert device 14 can inform the user that the laptop is present, but the battery is low. The acknowledgment signal can also contain voicemail information for a cellular telephone. The user alert device 14 can inform the user that there are voicemails or missed calls. In addition, if a device 20 is not present, user alert device 14 can inform the user of the last time the device was present.

Figure 2:
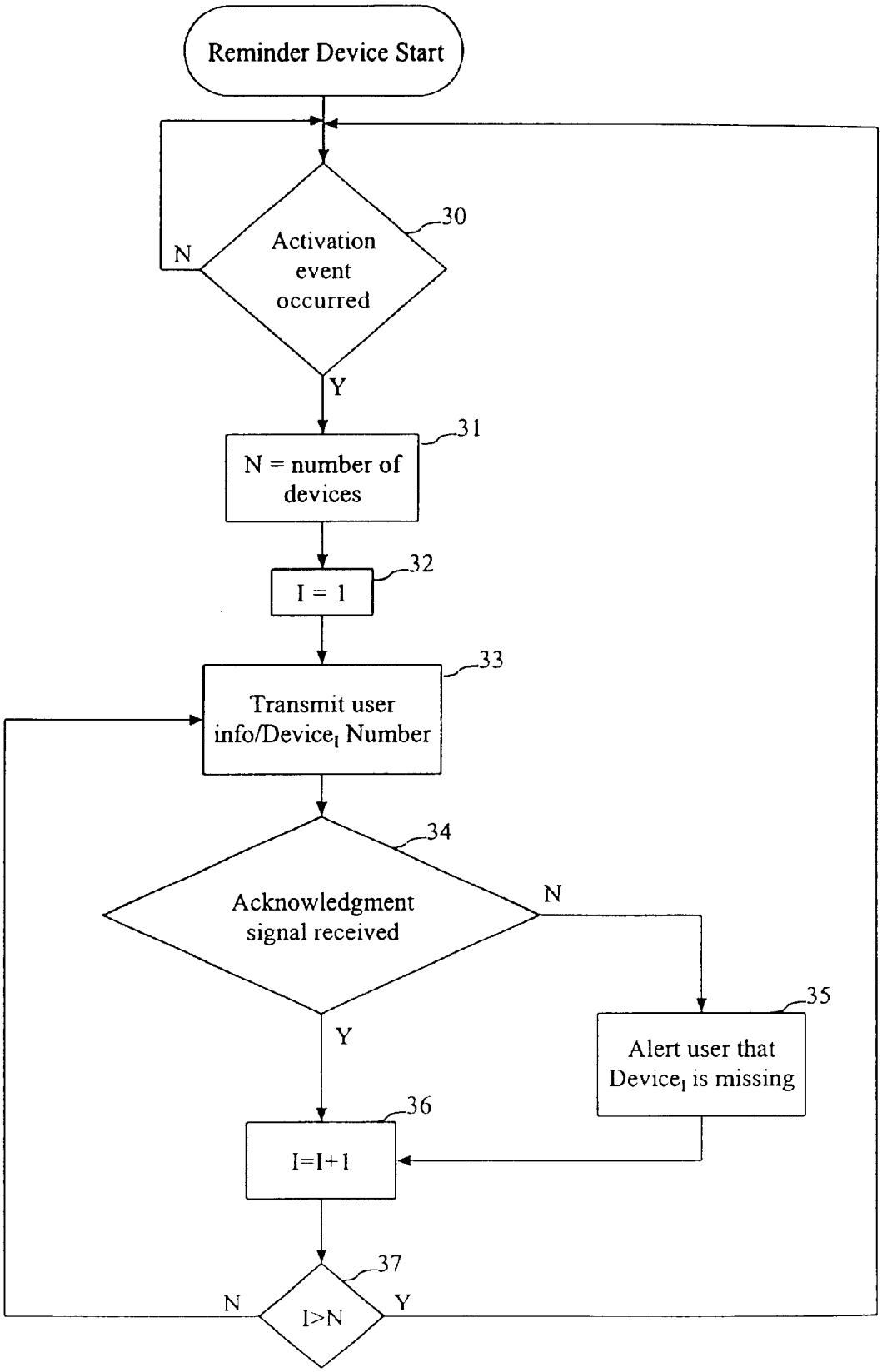
FIG. 2 is a flowchart of an exemplary method implemented in a reminder device for a wireless pico-net based personal property reminder.

FIG. 2 illustrates in flowchart form the processing performed by a reminder device 10 under control of microprocessor 13. Once a reminder device 10 has identification information on each reminder enabled portable electronic device 20 input into the information storage device 17, the microprocessor 13 checks if an activation event has occurred at processing segment 30. An activation event can be starting a car, opening a car door, opening a garage door, opening the front door of a house, a pre-set time, or any other event. If the activation event occurred as detected at processing segment 30, then the microprocessor 13 sets a variable ("N") to the number of devices that need to be checked at segment 31, sets another variable ("I") to 1 at segment 32, and broadcasts the user information and information for device (I) at segment 33. The microprocessor 13 then checks if an acknowledgement signal is received within a pre-set period of time at processing segment 34 indicating that device(I) is nearby, e.g. within range. If the acknowledgment signal is not received, the microprocessor 13 alerts the user that device(I) is missing at segment 35. The microprocessor 13 can alert the user that a reminder enabled device 20 is missing by displaying a message on the display 14 and/or providing an audio signal through speaker 16, flashing lights, sounding a car alarm, beeping, etc., or any other suitable method. The user may then turn off the alarm, set it to check again at a later time, or remove a particular device from the checklist for the day.

If the acknowledgment signal is received as detected at processing segment 34, or after the user is alerted that a reminder enabled device 20 is missing at segment 35, the microprocessor 13 increments the variable I (the current device 20) at segment 36. The microprocessor 13 then checks if the variable I is greater than the variable N (the total number of devices 20) at processing segment 37. If I is greater than N, indicating that all reminder enabled devices have been checked for, then the microprocessor 13 returns to reminder device start. If I is not greater than N, then the microprocessor 13 returns to segment 33 to check for the next device 20 and continues the loop until all of the reminder enabled devices 20 identified in storage device 17 have been detected or the user has been alerted to any missing devices 20.

FIG. 3 illustrates in flowchart form the processing performed by a reminder enabled device 20. Once a reminder enabled device 20 has identification information input and stored in the information storage device 25, its microprocessor 23 checks if a signal is received from a reminder device 10 at processing segment 70. If a signal is received from a reminder device 10 as detected at processing segment 70, the microprocessor 23 checks if it is the current device by comparing the portable electronic device 20 identification information contained in the signal received with the user information and device information in the information storage device 24 at processing segment 40. If the information stored in the information storage device 25 does not match, as detected at processing segment 40, the microprocessor 23 returns to processing segment 70. If the information matches, the microprocessor 23 broadcasts an acknowledgement signal at segment 39 and then returns to processing segment 70 to await another signal.

Figure 4:
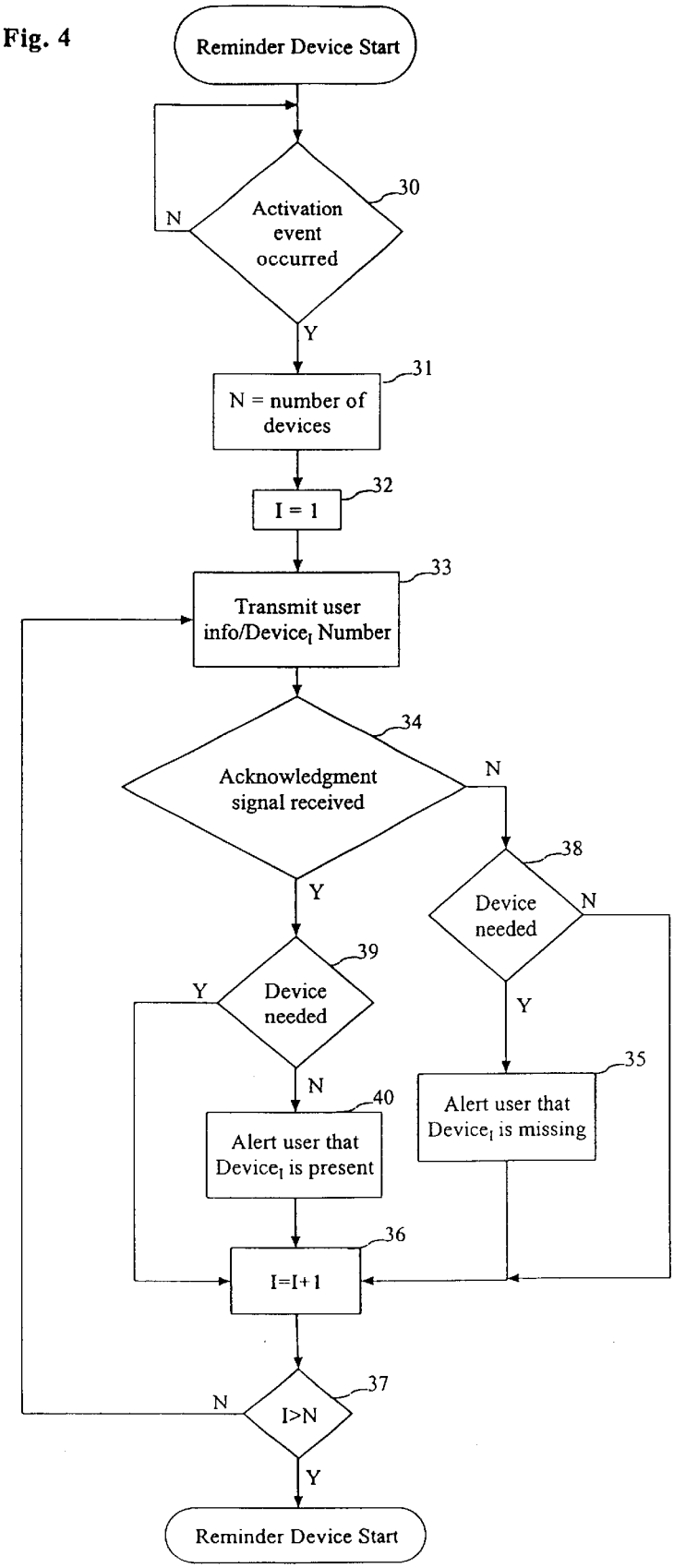
FIG. 4 is a flowchart of an exemplary method implemented in a reminder device for a wireless pico-net based personal property reminder that verifies that some reminder enabled devices are present and that some reminder enabled devices are absent.

FIG. 4 illustrates in flowchart form a modification of how a reminder device 10 can operate. The only difference between FIG. 4 and FIG. 2 is the addition of processing segments 38 and 39 and segment 40. In this modification, in addition to verifying that the reminder enabled devices 20 that should be present arc not absent, the reminder device 10 verifies that reminder enabled devices 20 that should be absent are not present.

In this modification, if an acknowledgement signal is not received as detected at processing segment 34, the microprocessor 13 checks if device(I) is needed at processing segment 38. If device(I) is needed as detected at processing segment 38, the microprocessor 13 activates the display 14 to inform the user that a necessary device is missing at segment 35 and proceeds to segment 36 to continue checking for reminder enabled devices. If device (I) is not needed as detected at processing segment 38, the microprocessor 13 proceeds to segment 37.

If an acknowledgment signal is received as detected at processing segment 34, the microprocessor 13 checks if device (I) is needed at processing segment 39. If device (I) is needed as detected at processing segment 39, the microprocessor 13 proceeds to segment 36. If device (I) is not needed as detected at processing segment 39, the microprocessor 13 activates the display 14 to inform the user that the device is present at segment 40 and proceeds to segment 36.

Figure 5:
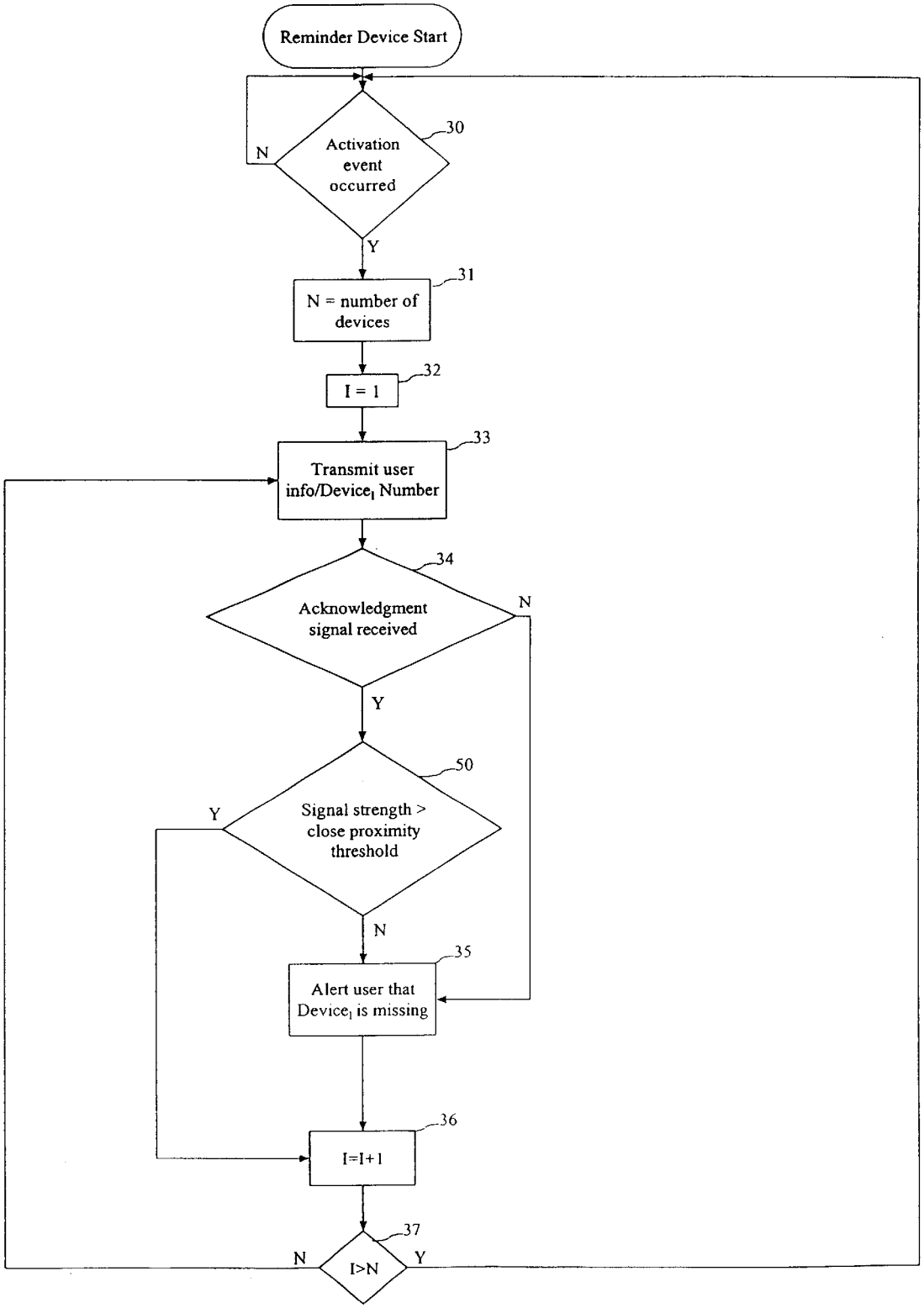
FIG. 5 is a flowchart of an exemplary method implemented in a reminder device for a wireless pico-net based personal property reminder that verifies that each reminder enabled device is within range by comparing the signal strength to a threshold signal strength.

FIG. 5 illustrates in flowchart form another modification of how a reminder device 10 can operate. The only difference between FIG. 5 and FIG. 2 is the addition of processing segment 50. In this modification, in addition to determining that a reminder enabled device 20 is absent if it does not transmit an acknowledgment signal, the reminder device 10 also compares the signal strength of the acknowledgment signals received to a close proximity threshold signal strength to make sure the reminder enabled devices 20 that do respond are close enough.

In this modification, after an acknowledgment signal is received as detected at processing segment 34, the microprocessor 13 determines if the signal strength of the acknowledgment signal is greater than the proximity threshold signal strength at processing segment 50. If the signal strength is greater than the close proximity threshold as detected at processing segment 40, the microprocessor 13 proceeds to segment 36 to increment I. If the signal strength is not greater than the proximity threshold as detected at processing segment 40, the microprocessor 13 proceeds to segment 35 to alert the user that the device is not present.

The close proximity threshold can be set by the user based on what reminder device 10 is. For example, if reminder device 10 is a car, the close proximity threshold would be set to a distance that would include the trunk, but not any farther. If reminder device 10 is a processor in a building that is activated when a door is opened, the close proximity threshold would be set to a distance that would include a small area around the door so that the user would be alerted about any reminder enabled devices 20 in the building, but not near the user.

Figure 6:
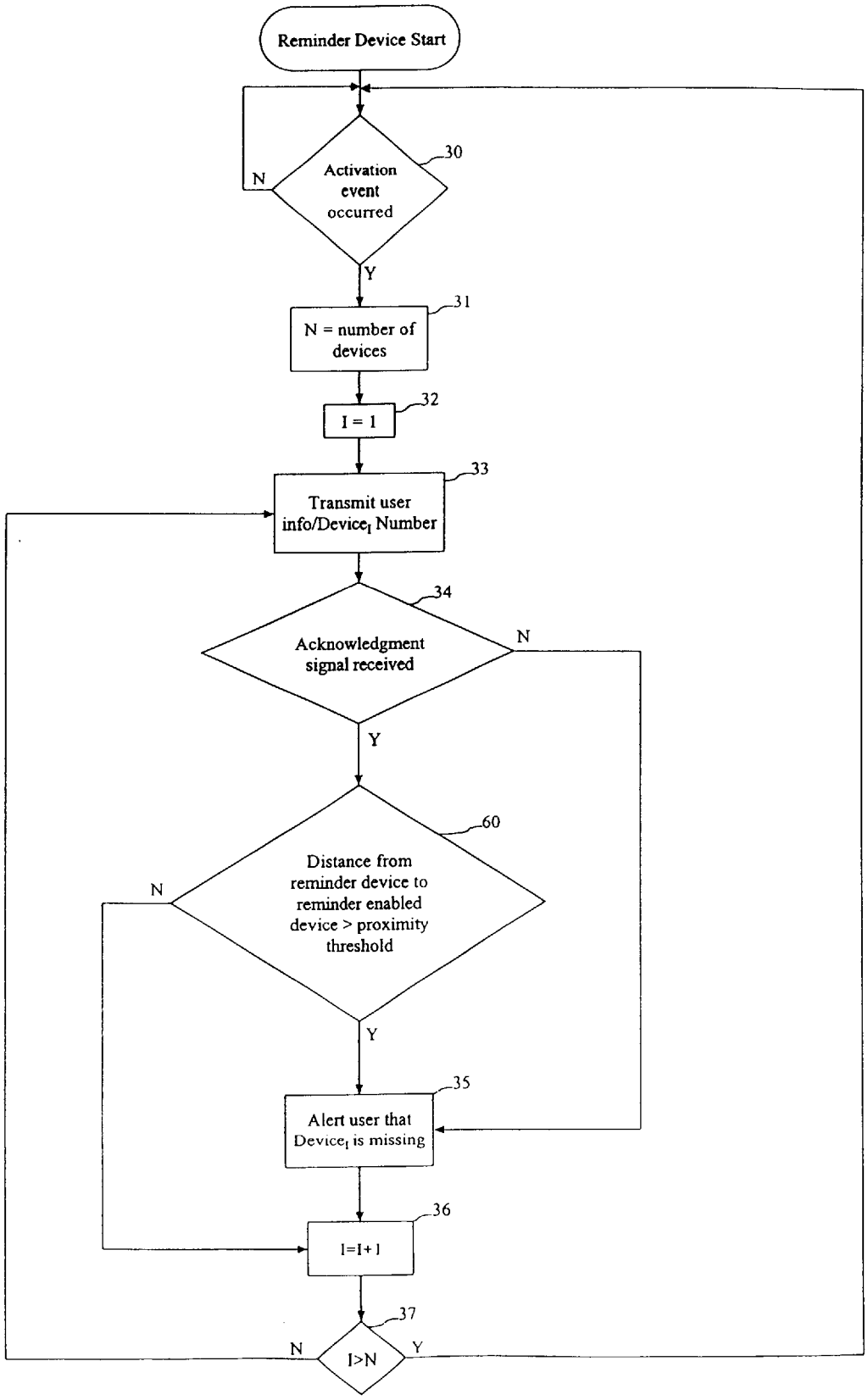
FIG. 6 is a flowchart of an exemplary method implemented in a reminder device for a wireless pico-net based personal property reminder using GPS coordinates to verify that each reminder enabled device is within a threshold distance.

FIG. 6 illustrates in flowchart form another modification of how a reminder device 10 can operate. The only difference between FIG. 6 and FIG. 2 is the addition of processing segment 60. In this modification, instead of testing the strength of the response signal to determine if reminder enabled devices 20 are within range, as in FIG. 5, the reminder device 10 verifies proximity using a global positioning satellite.

In this modification, the acknowledgment signal received from each reminder enabled device 20 at processing segment 34 contains its GPS coordinates. The reminder device 10 then determines its own location and the location of each reminder enabled device 20. Once the acknowledgment signal is received from a reminder enabled device 20 as detected at processing segment 34, the reminder device 10 determines if the distance from the reminder device 10 to the reminder enabled device 20 is greater than the proximity threshold at processing segment 60. If the distance exceeds the threshold as detected at processing segment 60, the microprocessor 13 proceeds to segment 35 to alert the user that the device is missing. If the distance is within the threshold, the microprocessor proceeds to segment 36 to increment the device number and verify the presence of the next device.

Figure 7:
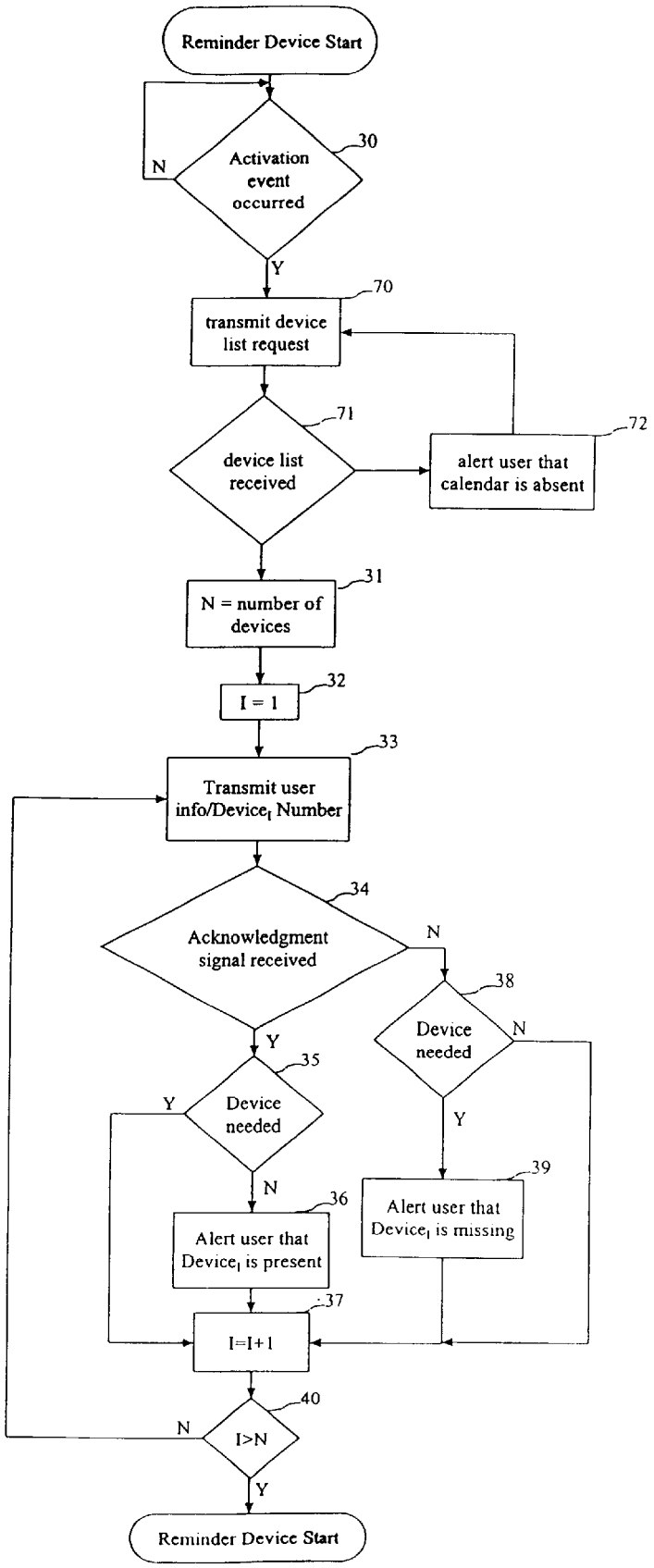
FIG. 7 is a flowchart of an exemplary method implemented in a reminder device for a wireless pico-net based personal property reminder that synchronizes with an electronic calendar to verify that the reminder enabled devices necessary for each days schedule are present and that the reminder enabled devices that should be absent for the present days schedule are absent.
Figure 7:
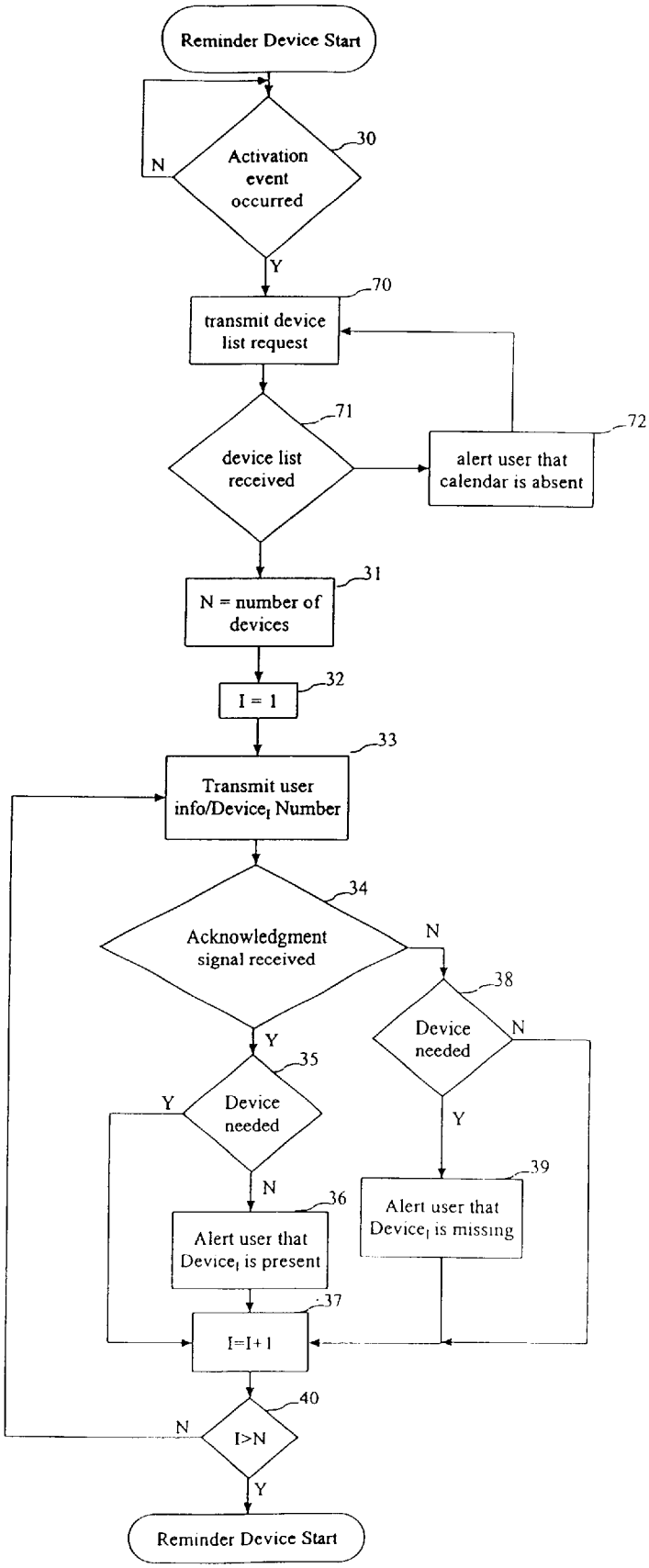

FIG. 7 illustrates in flowchart for another modification of how a reminder device 10 can operate. The only difference between FIG. 6 and FIG. 4 is the addition of processing segment 71 and segments 70 and 72. In this modification, instead of having the user input which reminder enabled devices 20 should be present and which reminder enabled devices 20 should be absent for each day of the week, the reminder device 10 communicates with the user's electronic calendar to determine which reminder enabled devices 20 are necessary for each day's schedule and which reminder enabled devices 20 should be absent for each day's schedule.

In this modification, after the activation event occurs at processing segment 30, the reminder device 10 transmits a device list request to the user's electronic calendar at segment 70. The device list contains a list of which reminder enabled devices 20 should be present and which reminder enabled devices 20 should be absent. After the device list request is transmitted at segment 70, the microprocessor 71 checks if the device list is received at processing segment 71. If the device list is not received as detected at processing segment 71, the microprocessor 13 activates the display 14 to notify the user that the electronic calendar is missing at segment 72 and returns to segment 70. If the device list is received as detected at processing segment 71, the microprocessor proceeds to segment 31 to verify that the reminder enabled devices are present or absent as in FIG. 4.

In order to standardize the system for various products from different manufacturers, a protocol must be established. One such protocol is known as Bluetooth™. Bluetooth™ is a radio frequency standard that describes how portable electronic devices, such as, for example, wireless telephones, PDAs, and personal computers, can easily interconnect with each other and with home and business phones and computers using a short-range wireless connection. The Bluetooth™ specification ensures that diverse devices supporting the Bluetooth™ technology can communicate with each other worldwide. The Bluetooth™ protocol allows for the automatic connections between the devices without any user intervention. Thus, when Bluetooth™ equipped devices come within range of one another, such as, for example, when a reminder enabled device 20 is within range of a reminder device 10, the devices can communicate with each other via a radio frequency.

While the Bluetooth™ protocol can be used with the present invention, the communications do not have to be by the Bluetooth™ protocol.

It should be noted that while the invention has been described with reference to detecting portable electronic devices 20 that are left behind, it is also possible to attach or otherwise couple a reminder enabled device 20 to any object where it is desired to detect if that object has been left behind.

While the invention has been described with reference to an exemplary embodiments various additions, deletions, substitutions, or other modifications may be made without departing from the spirit or scope of the invention. Accordingly, the invention is not to be considered as limited by the foregoing description, but is only limited by the scope of the appended claims.

What is claimed as new and desired to be protected by letters patent of the united states is:

1. A system for detecting presence or absence of a portable electronic device, said detection system comprising:

at least one portable electronic device; and a reminder device for transmitting a signal to said portable electronic device;

said at least one portable electronic device, based on predetermined conditions, receiving said signal and sending a response signal to said reminder device; and said reminder device providing a notification indicating the presence or absence of said at least one portable electronic device within a specified proximity to said reminder device based on said response signal.

2. The system as in claim 1, wherein said reminder device includes a control circuit.

3. The system as in claim 2, wherein said control circuit is a microprocessor.

4. The system as in claim 1, wherein said reminder device is provided at a specific location where detection of the presence or absence of said portable electronic device is desired.

5. The system as in claim 4, wherein said location is an automobile.

6. The system as in claim 5, wherein the activation event is the starting of said automobile.

7. The system as in claim 5, wherein said activation event is opening of a door of said automobile.

8. The system as in claim 4, wherein said reminder device is located in a building.

9. The system as in claim 8, wherein said activation event is the opening of a door of said building.

10. The system as in claim 9, wherein said door is a garage door of said building.

11. The system as in claim 1, wherein said reminder device includes a clock and said activation event is a pre-determined time.

12. The system as in claim 1, wherein said reminder device only provides said first signal on user-selected days of the week.

13. The system as in claim 1, wherein said portable electronic device comprises a transferable tag.

14. The system as in claim 1, wherein said reminder device further comprises:

a storage device to store identification information for said portable electronic device.

15. The system of claim 14, wherein said reminder device further comprises:

an input device to allow a user to input said identification information for said portable electronic device.

16. The system as in claim 1, wherein each of said reminder device and said portable electronic device includes a radio transceiver, and said first signal and said second response signal are radio signals.

17. The system as in claim 16, wherein said transceiver devices are Bluetooth™ compliant.

18. The system as in claim 1, further comprising a plurality of portable electronic devices, said reminder device transmitting a first signal to said plurality of portable electronic devices in response to the occurrence of said activation event, each of said plurality of portable electronic devices that receive said first signal providing a second response signal, said reminder device providing said notification if at least one of said plurality of portable electronic devices does not provide said second response signal.

19. The system as in claim 18, wherein said second response signal contains said identification information.

20. The system as in claim 19, wherein said reminder device further comprises:

a storage device to store identification information for said plurality of portable electronic devices.

21. The system as in claim 20, wherein said reminder device further comprises:

an input device to allow a user to input identification information for said plurality of portable electronic devices.

22. The system as in claim 21, wherein said reminder device determines which of said plurality of portable electronic devices transmitted said second response by comparing said identification information contained in said second response signal to identification information stored in said storage device.

23. The system as in claim 18, wherein said notification is a list of which of said portable electronic devices did not transmit said second response signal.

24. The system as in claim 18, wherein said notification is provided if at least one of said plurality of portable electronic devices that are supposed to be present does not provide said second response signal.

25. The system as in claim 24, herein said reminder device checks if each of said plurality of electronic devices transmitting said second response signal should be absent and providing said notification if at least one of said plurality of electronic devices transmitting said second response signal should be absent.

26. The system as in claim 25, wherein said reminder device transmits a third signal to an electronic calendar and detects a fourth response signal from said electronic calendar containing a list of which of said portable electronic devices should be present.

27. The system as in claim 26, wherein said list also contains which of said portable electronic devices should be absent.

28. The system as in claim 1, wherein said portable electronic device is a laptop computer.

29. The system as in claim 1, wherein said portable electronic device is a cellular telephone.

30. The system as in claim 1, wherein said portable electronic device is a MP3 player.

31. The system as in claim 1, wherein said portable electronic device is a pager.

32. The system as in claim 1, wherein said portable electronic device is a PDA.

33. The system as in claim 1, wherein said transmission of said first and second signals have a limited range.

34. The system as in claim 1, wherein said reminder device provides said notification if said response signal's strength is below a threshold.

35. The system as in claim 1, wherein said response signal contains said at least one portable electronic device's location as determined by a global positioning satellite.

36. The system as in claim 35, wherein said reminder device provides said notification if the distance from said reminder device to said at least one portable electronic device is greater than a user defined distance as determined by the locations obtained from a global positioning satellite.

37. The system as in claim 1, wherein said notification is provided if said second response signal is received.

38. A portable electronic device comprising:

a transceiver;

a controller coupled to said transceiver; and an information storage device coupled to said controller to store device identification information associated with said portable electronic device;

wherein when said transceiver receives a signal containing device identification information from a reminder device, said controller verifies whether said device identification information contained in said signal matches the stored device identification information associated with said portable electronic device and, if it does, said controller causes said transceiver to transmit a response signal indicating to said reminder device the presence or absence of said portable electronic device within a specified proximity to said reminder device.

39. A device as in claim 38, further comprising an input device for inputting said device identification information associated with said portable electronic device to said information storage device.

40. A device as in claim 38, wherein said device identification information stored in said information storage device is stored using an input device equipped with a transceiver that transmits said information to said portable electronic device.

41. A device as in claim 38, wherein said information stored in said information storage device is stored using an input device attached to a reminder device, said reminder device transmitting a signal containing said information.

42. A device as in claim 38, wherein said transceiver is Bluetooth™ compliant.

43. A device as in claim 38, wherein said controller is a microprocessor.

44. A reminder device comprising:

a transceiver;

a controller coupled to said transceiver;

an information storage device coupled to said controller; and a user alert device coupled to said controller;

wherein when an activation event occurs, said transceiver transmits a first signal containing information to identify at least one portable electronic device, said controller activating said user alert device to indicate the presence or absence of said at least one portable electronic device within a specified proximity to said reminder device based on receipt of a response signal from said at least one portable electronic device.

45. A device as in claim 44, wherein said controller is a microprocessor.

46. A device as in claim 44, wherein said transceiver is Bluetooth™ compliant.

47. A device as in claim 44, wherein said user alert device is a display device that displays a visual message.

48. A device as in claim 44, wherein said user alert device is a speaker to provide an audio message.

49. A device as in claim 44, wherein said user alert device is at least one light.

50. A device as in claim 44, wherein said activation event is the opening of an automobile door.

51. A device as in claim 44, wherein said activation event is the starting of an automobile.

52. A device as in claim 44, wherein said activation event is a pre-determined time.

53. A device as in claim 44, wherein said activation event is the opening of a garage door.

54. A device as in claim 44, wherein said activation event is the opening of a door of a building.

55. A device as in claim 44, wherein said controller causes said reminder device to only provide said first signal on user-selected days of the week.

56. A device as in claim 44, wherein said user alert device provides a list of which of said portable electronic devices did not transmit said second response signal.

57. A device as in claim 44, wherein said user alert device provides a list of which of said portable electronic devices transmitted said second response signal.

58. A device as in claim 57, wherein said user alert device further provides a list of which of said portable electronic devices that are not supposed to be present transmitted said second response signal.

59. A device as in claim 57, wherein said reminder device transmits a third signal to an electronic calendar and detects a fourth response signal containing a list of which devices should be present and which devices should not be present.

60. A method for determining presence or absence of a portable electronic device when leaving a location comprising the steps of:

transmitting a first signal to at least one portable electronic device;

detecting if a second response signal is received from said portable electronic device; and providing an indication of the presence or absence of said at least one portable electronic device within a specified proximity of a reminder device based on whether said second signal is received.

61. A method as in claim 60, wherein said first and second signals are radio signals.

62. A method as in claim 60, wherein said indication is a visual indication.

63. A method as in claim 60, wherein said indication is an audio indication.

64. A method as in claim 60, further comprising the steps of:

transmitting a plurality of first signals to a plurality of portable electronic devices;

detecting if a second response signal is received from each of said plurality of portable electronic devices; and providing an indication based on whether each second response signal is not received.

65. A method as in claim 64, further comprising the steps of:

transmitting a third signal to an electronic calendar; and detecting if a fourth response signal containing a list of which of said plurality of portable electronic devices should be present and which of said plurality of portable electronic devices should not be present is received from an electronic calendar.

66. A method for detecting presence or absence of portable electronic devices when leaving a location comprising the steps of:

detecting a first signal at said portable electronic device;

comparing identification information contained in said first signal to stored identification information; and transmitting a second response signal indicating to a reminder device whether said portable electronic device is within a specified proximity of said reminder device if said identification information in said first signal matches said stored identification information.

67. A method as in claim 66, wherein said first and second signals are radio signals.

68. A method as in claim 66, wherein said radio signals are Bluetooth™ compliant.

69. A method for detecting presence or absence of a portable electronic devices when leaving a location comprising the steps of:

transmitting a first signal for each portable electronic device from a reminder device, each said first signal including identification information associated with one of said portable electronic devices;

detecting each of said first signals at each of said portable electronic devices within range to receive said first signals;

comparing said identification information in said first signals to identification information stored in each of said portable electronic devices that detect said first signals;

transmitting a second response signal from one of said portable electronic devices to said reminder device if said identification information in one of said first signals matches said information stored in said portable electronic device;

detecting each said second response signal at said reminder device; and providing an indication of the presence or absence within a specified proximity of said reminder device of each of said portable electronic devices based on a second response signal was detected from each portable electronic device.

70. A method as in claim 69, further comprising the steps of:

transmitting a third signal from said reminder device to an electronic calendar;

detecting said third signal at said electronic calendar;

transmitting a fourth response signal from said electronic calendar to said reminder device containing a list of which of said portable electronic devices should be present and which of said portable electronic devices should not be present; and detecting if said fourth response signal is received from said electronic calendar.

71. A method as in claim 69, wherein said indication is a visual indication.

72. A method as in claim 69, wherein said indication is an audio indication.

73. A method as in claim 69, wherein said first and second signals are Bluetooth™ compliant.

* * * * *